US006761106B2

(12) United States Patent
Sugiura et al.

(10) Patent No.: US 6,761,106 B2
(45) Date of Patent: Jul. 13, 2004

(54) SWASH PLATE FOR COMPRESSOR

(75) Inventors: Manabu Sugiura, Kariya (JP); Takahiro Sugioka, Kariya (JP); Akira Onoda, Kariya (JP); Tomohiro Murakami, Kariya (JP); Shino Okubo, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 10/125,855

(22) Filed: Apr. 18, 2002

(65) Prior Publication Data

US 2002/0152888 A1 Oct. 24, 2002

(30) Foreign Application Priority Data

Apr. 20, 2001 (JP) ..... 2001-123040

(51) Int. Cl.[7] ..... F01B 31/10
(52) U.S. Cl. ..... 92/155; 92/71
(58) Field of Search ..... 92/71, 155; 91/499, 91/500, 501, 502, 503, 504, 505; 417/221, 269; 74/60, 839

(56) References Cited

U.S. PATENT DOCUMENTS 5,875,702 A * 3/1999 Kawagoe et al. ..... 92/71
5,974,946 A 11/1999 Kanou et al. ..... 92/71

FOREIGN PATENT DOCUMENTS

EP 1 045 041 A1 10/2000 ..... C22C/9/04
JP 08-199327 8/1996 ..... C23C/4/04

* cited by examiner

*Primary Examiner*—Edward K. Look
*Assistant Examiner*—Michael Leslie
(74) *Attorney, Agent, or Firm*—Morgan & Finnegan, LLP

(57) ABSTRACT

A compressor includes pistons, each of which is coupled to a swash plate through a pair of shoes. The swash plate rotates integrally with a drive shaft. The shoes convert the rotation of the swash plate to the reciprocation of the piston. A lubricating coating made of copper-based material is formed on parts of the swash plate along which the shoes slide. The copper-based material includes silicon. The shoes smoothly slide on the swash plate, which is coated by the lubricating coating that uses minimum amount of lead.

13 Claims, 2 Drawing Sheets

SWASH PLATE FOR COMPRESSOR

BACKGROUND OF THE INVENTION

The present invention relates to a swash plate for a compressor.

Japanese Laid-Open Patent Publication No. 8-199327 discloses pistons for a swash plate type compressor. The pistons reciprocate in accordance with the rotation of a swash plate, which rotates integrally with a drive shaft. Each piston is coupled to the peripheral portion of the swash plate through a pair of shoes. The rotation of the swash plate is converted to the reciprocation of the pistons by the shoes.

The pair of shoes is made of metal material (for example, iron-based material) that is the same material as used for the swash plate. A lubricating coating made of copper-based material is applied to the swash plate surface that contacts the pair of shoes so that the shoes smoothly slides on the swash plate and the seizure is prevented from occurring between the pair of shoes and the swash plate. It is also proposed to add lead in the copper-based material so that the shoes further smoothly slides on the swash plate.

As the concern over the environmental problems has increased, it is desired to use materials that minimize adverse environmental effect in lubricating coatings.

SUMMARY OF THE INVENTION

The objective of the present invention is to provide a swash plate for a compressor that includes minimum amount of lead while permitting shoes to reliably slide with respect to the swash plate.

To achieve the foregoing objective, the present invention provides a swash plate for a compressor, which includes a piston coupled to the swash plate through a pair of shoes. The swash plate rotates integrally with a drive shaft. The shoes slide on the piston and the swash plate. The shoes convert the rotation of the swash plate to the reciprocation of the piston. A lubricating coating made of copper-based material is formed on part of the swash plate along which the shoes slide. The copper-based material includes silicon.

The present invention also provides a manufacturing method of a swash plate for a compressor. The method includes forming a lubricating coating made of copper-based material including silicon at part of the swash plate along which a shoe slides.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which:

FIG. 1(*b*) is an enlarged partial cross-sectional view of the compressor shown in FIG. 1(*a*)

DETAILED DESCRIPTION OF THE PREFERRED EMBODIMENTS

A first embodiment of the present invention will now be described with reference to FIGS. 1(*a*) and 1(*b*).

Figure 1:
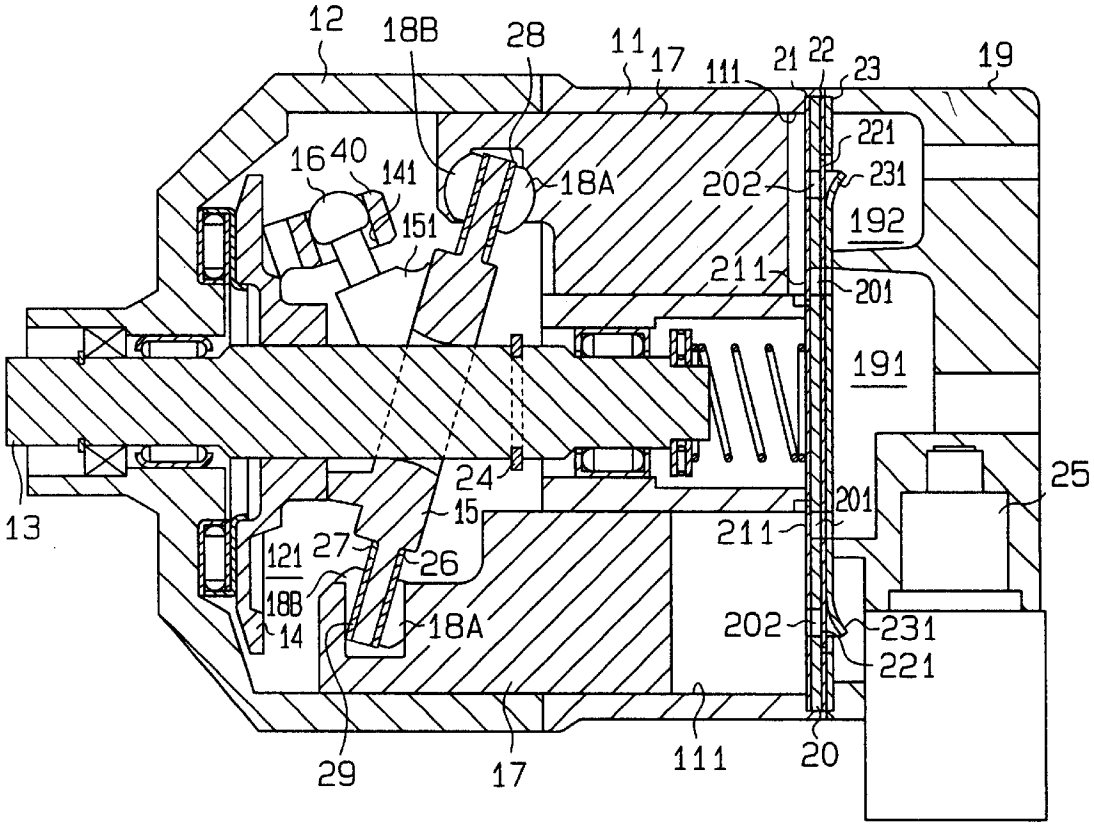
FIG. 1(*a*) is a cross-sectional view illustrating a swash plate type compressor according to a first embodiment of the present invention.
Figure 1:
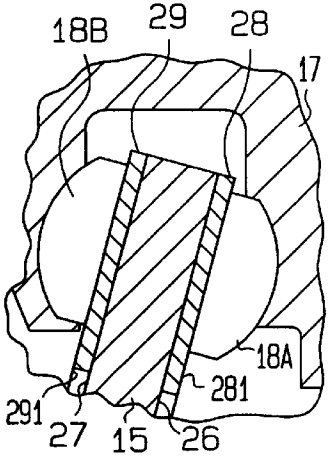

As shown in FIG. 1(*a*), a variable displacement compressor includes a front housing member 12, a rear housing member 19, and a cylinder block 11. A control pressure chamber 121 is defined between the front housing member 12 and the cylinder block 11. A drive shaft 13 extends through the control pressure chamber 121 and is rotatably supported by the front housing member 12 and the cylinder block 11. The drive shaft 13 is driven by an external drive source such as an engine. A lug plate 14 is fixed to the drive shaft 13. A swash plate 15 is supported by the drive shaft 13 to slide along and to tilt with respect to the axis of the drive shaft 13. In FIG. 1, the left end of the compressor is defined as the front end, and the right end of the compressor is defined as the rear end.

A swash plate 15 is made of an iron-based material. A supporting body 151 is formed integrally with the swash plate 15. Two guide pins 16 (only one is shown) are fixed to the supporting body 151. Two supporting arms 40 (only one is shown) extend from the lug plate 14. Each supporting arm 40 has a guide hole 141 (only one is shown). Each guide pin 16 is supported by the corresponding guide hole 141 and slides with respect to the guide hole 141. The swash plate 15 can be tilted with respect to the axis of the drive shaft 13 and rotates integrally with the drive shaft 13 by the cooperation between the supporting arms 40 and the guide pins 16. The swash plate 15 is selectively tilted with respect to the drive shaft 13 while axially moving along the drive shaft 13.

The inclination angle of the swash plate 15 is changed based on the pressure in the control pressure chamber 121. When the pressure in the control pressure chamber 121 increases, the inclination angle of the swash plate 15 decreases. When the pressure in the control pressure chamber 121 decreases, the inclination angle of the swash plate 15 increases. Refrigerant gas in the control pressure chamber 121 is drawn into a suction chamber 191 in the rear housing member 19 through a pressure release passage, which is not shown. Refrigerant gas in a discharge chamber 192 in the rear housing member 19 is drawn into the control pressure chamber 121 through a pressure passage, which is not shown.

A displacement control valve 25 is located in the pressure passage. The displacement control valve 25 controls the flow rate of refrigerant gas that is supplied from the discharge chamber 192 to the control pressure chamber 121. When the flow rate of refrigerant gas that is supplied from the discharge chamber 192 to the control pressure chamber 121 increases, the pressure in the control pressure chamber 121 increases. When the flow rate of refrigerant gas that is supplied from the discharge chamber 192 to the control pressure chamber 121 decreases, the pressure in the control pressure chamber 121 decreases. Therefore, the inclination angle of the swash plate 15 is controlled by the displacement control valve 25.

When the swash plate 15 contacts the lug plate 14, the swash plate 15 is at the maximum inclination angle. When the swash plate 15 contacts a snap ring 24 located on the drive shaft 13, the swash plate 15 is at the minimum inclination angle.

Cylinder bores 111 (only two are shown in FIG. 1(*a*)) are formed in the cylinder block 11 about the drive shaft 13. A piston 17 is accommodated in each cylinder bore 111. Each piston 17 is coupled to the peripheral portion of the swash plate 15 by a pair of a semi-spherical rear shoe 18A and a semi-spherical front shoe 18B. Therefore, when the swash plate 15 rotates with the drive shaft 13, the rear shoes 18A and the front shoes 18B convert the rotation of the swash plate 15 into the reciprocation of the pistons 17. As shown in FIG. 1(*b*), the rear shoes 18A, which are made of bearing steel, slide on a rear lubricating surface 281. The front shoes 18B, which are made of bearing steel, slide on a front lubricating surface 291.

A valve plate assembly is located between the cylinder block 11 and the rear housing member 19. The valve plate assembly includes a main plate 20, a first sub-plate 21, a second sub-plate 22, and a retainer plate 23.

The main plate 20 includes suction ports 201 and discharge ports 202. The first sub-plate 21 includes suction valves 211. The second sub-plate 22 includes discharge valves 221. A suction port 201, a discharge port 202, a suction valve 211, and a discharge valve 221 constitute a set that corresponds to one of the cylinder bores 111.

When each piston 17 moves from the top dead center position to the bottom dead center position, refrigerant gas in the suction chamber 191 is drawn into the corresponding cylinder bore 111 via the corresponding suction port 201 and suction valve 211.

When each piston 17 moves from the bottom dead center position to the top dead center position, refrigerant gas in the corresponding cylinder bore 111 is discharged to the discharge chamber 192 via the corresponding discharge port 202 and discharge valve 221. When the discharge valve 221 contacts a retainer 231 located on the retainer plate 23, the opening size of the discharge valve 221 is maximized.

As shown in FIGS. 1(*a*) and 1(*b*), a rear lubricating coating 28 is applied to a rear surface 26 of the swash plate 15. A front lubricating coating 29 is applied to a front surface 27 of the swash plate 15. The surface of the rear lubricating coating 28 forms a rear lubricating surface 281, which slides on the rear shoes 18A. The surface of the front lubricating coating 29 forms a front lubricating surface 291, which slides on the front shoes 18B.

The lubricating coatings 28, 29 may be made with metal materials such as brass or lead-free bronze, which include silicon and no lead. Alternatively, the lubricating coating 28, 29 may be made with an intermetallic compound of brass or lead free bronze and silicon. Hereinafter, these metal materials and the compound will be referred to as Cu—Si based material. The Cu—Si based material, which is copper-based material, changes properties such as the hardness and the melting point in accordance with the silicon content in the material. The Cu—Si based material used in the first embodiment has silicon content of 2 to 15% by weight (preferably 5 to 12%). The lubricating coatings 28, 29 are formed by the conventional metal spraying.

The lubricating coatings 28, 29, which are made of copper-based material having a suitable silicon content, slide with on the rear shoes 18A and the front shoes 18B as reliably as the prior art lubricating coating, which is made of copper-based material including lead. Furthermore, the lubricating coatings 28, 29 have improved wear resistance and anti-seizure property. The lubricating coating 28, 29 also do not include lead. Therefore, problems related to the environmental sanitation do not occur.

The iron-based material used for the swash plate 15, the rear shoe 18A, and the front shoe 18B is very hard and the melting point is between one thousand to two thousand degrees Celsius, which is relatively high. On the other hand, the Cu—Si based material used for the lubricating coatings 28, 29 is softer than the iron-based material and the melting point is less than one thousand degrees Celsius, which is lower than that of the iron-based material. The differences in the properties between the Cu—Si based material and the iron-based material improve the sliding performance of the swash plate 15 with respect to the rear shoe 18A and the front shoe 18B.

Figure 2:
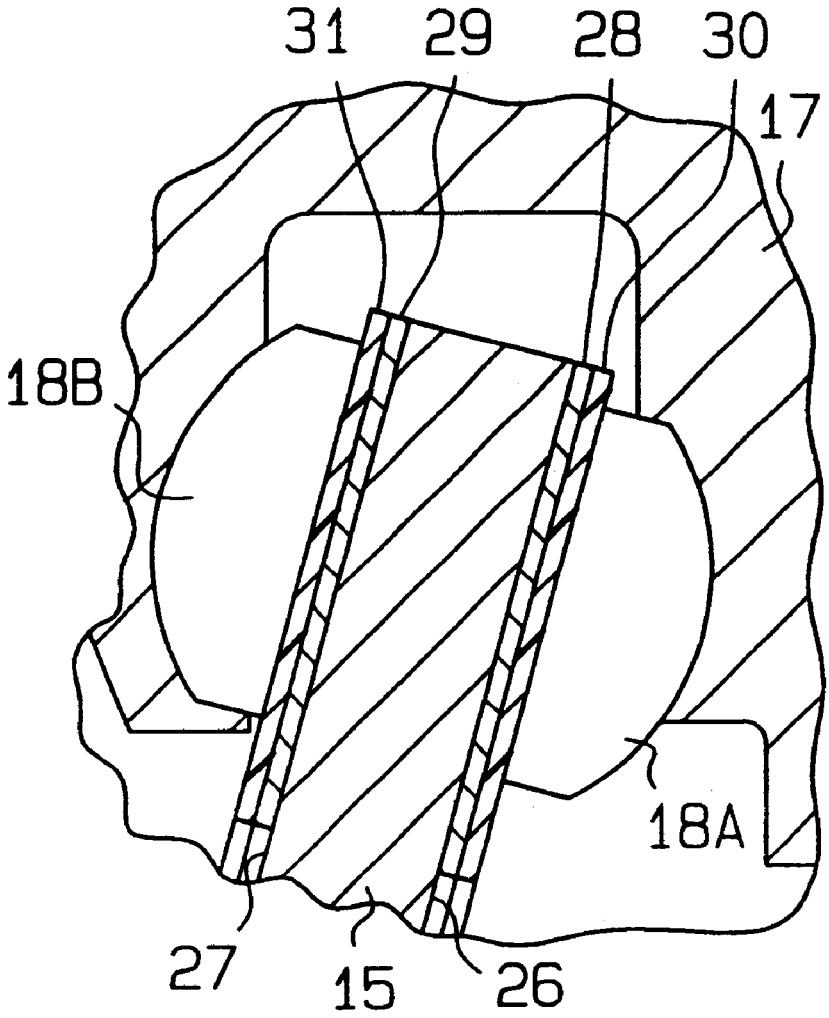
FIG. 2 is an enlarged partial cross-sectional view of a swash plate according to a second embodiment of the present invention.

A second embodiment of the present invention will now be described. The differences from the first embodiment illustrated in FIGS. 1(*a*) and 1(*b*) will mainly be described with reference to FIG. 2. As shown in FIG. 2, rear and front resin coatings 30, 31 are provided on the rear and front lubricating coatings 28, 29, which is made of metal, respectively. Solid lubricant is dispersed in the resin coatings 30, 31.

Since the lubricating coatings 28, 29 are not easily deformed, a crack is easily formed while the lubricating coatings 28, 29 are wear-resistant. Therefore, when the coatings 30 and 31, which are made of soft resin, are each provided on top of the corresponding one of the hard lubricating coatings 28, 29, each of the lubricating coatings 28, 29 does not directly contact the corresponding set of the rear shoes 18A and the front shoes 18B. Therefore, the lubricating coatings 28 and 29 are prevented from having cracks. In addition, since the lubricating coatings 28 and 29 are not easily deformed, the wear resistance is improved.

The solid lubricant in the second embodiment is at least one of, for example, molybdenum disulfide, tungsten disulfide, graphite, boron nitride, antimony oxide, lead oxide, lead, indium, and tin. The resin in the second embodiment is, for example, polyamide-imide resin.

It should be apparent to those skilled in the art that the present invention may be embodied in many other specific forms without departing from the spirit or scope of the invention. Particularly, it should be understood that the invention may be embodied in the following forms.

Powdered copper-based material to which silicon is added may be sintered and applied to the base material of the swash plate 15 to form the lubricating coatings 28 and 29. In this case, vibration and the generation of dust during the manufacturing procedure are reduced compared to a case, for example, when the metal spraying is performed. Thus, the work environment is improved.

The present invention may be applied to a swash plate that is made of aluminum-based material for reducing the compressor weight.

The moment of rotation based on the centrifugal force acts on a swash plate used in the variable displacement compressor when the swash plate is rotated. The moment of rotation affects the adjustment of the inclination angle of the swash plate. To generate a suitable moment of rotation, the weight of the swash plate needs to be increased. Therefore, a copper-based material, which is heavier than iron-based material, may be used for the swash plate in the same dimension and the same shape. In this case, the base material of the swash plate and the material of the lubricating coatings are the same. Thus, the swash plate is more firmly coupled to the lubricating coatings. This improves the endurance of the lubricating coatings.

The present invention may be applied to a swash plate for a swash plate type fixed displacement compressor.

Therefore, the present examples and embodiments are to be considered as illustrative and not restrictive and the invention is not to be limited to the details given herein, but may be modified within the scope and equivalence of the appended claims.

What is claimed is:

1. A swash plate for a compressor, which includes a piston coupled to the swash plate through a pair of shoes, wherein the swash plate rotates integrally with a drive shaft, and the shoes slide on the piston and the swash plate, wherein the shoes convert the rotation of the swash plate to the reciprocation of the piston, wherein a lubricating coating made of copper-based material is formed on part of the swash plate along which the shoes slide, wherein the copper-based material includes silicon, and wherein silicon content is greater than 5% and less than or equal to 15% by weight.

2. The swash plate according to claim 1, wherein the copper-based material includes no lead.

3. The swash plate according to claim 1, wherein a resin coating is formed on the surface of the lubricating coating, wherein solid lubricant is dispersed in the resin coating.

4. The swash plate according to claim 1, wherein iron-based material is used to form the swash plate.

5. The swash plate according to claim 1, wherein aluminum-based material is used to form the swash plate.

6. The swash plate according to claim 1, wherein copper-based material is used to form the swash plate.

7. The swash plate according to claim 1, wherein the lubricating coating is formed on the swash plate by spraying.

8. The swash plate according to claim 1, wherein the lubricating coating is formed on the swash plate by sintering.

9. A manufacturing method of a swash plate for a compressor comprising forming a lubricating coating made of copper-based material including silicon at part of the swash plate along which a shoe slides, and wherein silicon content is greater than 5% and less than or equal to 15% by weight.

10. The manufacturing method according to claim 9, wherein the copper-based material includes no lead.

11. The manufacturing method according to claim 9, wherein a resin coating is formed on the surface of the lubricating coating, wherein solid lubricant is dispersed in the resin coating.

12. A swash plate for a compressor, which includes a piston coupled to the swash plate through a pair of shoes, wherein the swash plate rotates integrally with a drive shaft, and the shoes slide on the piston and the swash plate, wherein the shoes convert the rotation of the swash plate to the reciprocation of the piston, wherein a lubricating coating made of copper-based material is formed on part of the swash plate along which the shoes slide, wherein the copper-based material includes silicon, and wherein a resin coating is formed on the surface of the lubricating coating, and wherein solid lubricant is dispersed in the resin coating.

13. A swash plate for a compressor, which includes a piston coupled to the swash plate through a pair of shoes, wherein the swash plate rotates integrally with a drive shaft, and the shoes slide on the piston and the swash plate, wherein the shoes convert the rotation of the swash plate to the reciprocation of the piston, wherein a lubricating coating made of copper-based material is formed on part of the swash plate along which the shoes slide, wherein the copper-based material includes silicon, and wherein copper-based material is used to form the swash plate.

* * * * *